US006202431B1

(12) United States Patent
Beaverson et al.

(10) Patent No.: US 6,202,431 B1
(45) Date of Patent: Mar. 20, 2001

(54) ADAPTIVE HOT GAS BYPASS CONTROL FOR CENTRIFUGAL CHILLERS

(75) Inventors: Gregory K. Beaverson; Harold B. Ginder, both of York; Dennis L. Deltz, Windsor, all of PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/232,558

(22) Filed: Jan. 15, 1999

(51) Int. Cl.[7] ..... F25B 41/00

(52) U.S. Cl. ..... 62/196.3; 62/201; 62/209

(58) Field of Search ..... 62/126, 129, 196.1, 62/196.3, 203, 204, 217, 228.1, 228.3, 228.4, 228.5

(56) References Cited

U.S. PATENT DOCUMENTS

| | | | | |
|---|---|---|---|---|
| Re. 33,620 | | 6/1991 | Persem | 62/215 |
| 2,739,451 | | 3/1956 | Breck . | |
| 2,888,809 | * | 6/1959 | Rachfal | 62/196.3 |
| 3,174,298 | | 3/1965 | Kleiss . | |
| 3,250,084 | | 5/1966 | Anderson . | |
| 3,355,906 | | 12/1967 | Newton . | |
| 3,522,711 | | 8/1970 | Shaughnessy . | |
| 3,555,844 | | 1/1971 | Fleckenstein et al. . | |
| 3,780,532 | | 12/1973 | Norbeck et al. | 62/201 |
| 4,151,725 | | 5/1979 | Kountz et al. | 62/182 |
| 4,156,578 | | 5/1979 | Agar et al. | 415/1 |
| 4,164,034 | | 8/1979 | Glennon et al. | 364/431 |
| 4,177,649 | | 12/1979 | Venema | 62/209 |
| 4,183,225 | | 1/1980 | Politte et al. | 62/114 |
| 4,248,055 | | 2/1981 | Day, III et al. | 62/196 C |
| 4,259,845 | | 4/1981 | Norbeck | 62/209 |
| 4,275,987 | | 6/1981 | Kountz et al. | 415/17 |
| 4,282,718 | | 8/1981 | Kountz et al. | 62/115 |
| 4,282,719 | | 8/1981 | Kountz et al. | 62/115 |
| 4,355,948 | | 10/1982 | Kountz et al. | 415/1 |
| 4,522,037 | | 6/1985 | Ares et al. | 62/196.4 |
| 4,546,618 | | 10/1985 | Kountz et al. | 62/201 |
| 4,581,900 | | 4/1986 | Lowe et al. | 62/228.1 |
| 4,608,833 | | 9/1986 | Kountz | 62/228.1 |
| 4,686,834 | | 8/1987 | Haley et al. | 62/209 |
| 4,726,738 | | 2/1988 | Nakamura et al. | 417/22 |
| 4,947,653 | | 8/1990 | Day et al. | 62/73 |
| 5,065,590 | | 11/1991 | Powell et al. | 62/175 |
| 5,158,024 | | 10/1992 | Tanaka et al. | 110/186 |
| 5,259,210 | | 11/1993 | Ohya et al. | 62/212 |
| 5,272,428 | | 12/1993 | Spiegel et al. | 318/803 |
| 5,284,026 | | 2/1994 | Powell | 62/209 |
| 5,355,691 | | 10/1994 | Sullivan et al. | 62/201 |
| 5,537,830 | | 7/1996 | Goshaw et al. | 662/201 |
| 5,553,997 | | 9/1996 | Goshaw et al. | 415/17 |
| 5,669,225 | | 9/1997 | Beaverson et al. | 62/201 |
| 5,746,062 | | 5/1998 | Beaverson et al. | 62/228.3 |
| 5,873,257 | * | 2/1999 | Peterson | 62/129 X |
| 5,894,736 | | 4/1999 | Beaverson et al. | 62/230 |
| 5,947,680 | | 9/1999 | Harada et al. | 415/17 |

FOREIGN PATENT DOCUMENTS

| | | |
|---|---|---|
| 1-281353 | 11/1989 | (JP) . |
| 4-260755 | 9/1992 | (JP) . |
| 4-297761 | 10/1992 | (JP) . |
| 5-52433 | 3/1993 | (JP) . |
| 6-185786 | 7/1994 | (JP) . |

OTHER PUBLICATIONS

PCT International Search Report, International Application No. PCT/US00/00729, Apr. 21, 2000, 5 pages.

* cited by examiner

*Primary Examiner*—Harry B. Tanner
(74) *Attorney, Agent, or Firm*—Finnegan, Henderson, Farabow, Garrett & Dunner, L.L.P.

(57) ABSTRACT

An adaptive control apparatus and a method for automatically controlling a refrigeration system as a function of cooling load and head. A control panel controls the operation of a hot gas bypass valve so as to avoid surging of the compressor in response to cooling load and head. The control apparatus and method also allow for automatic self calibration.

32 Claims, 11 Drawing Sheets

| PRV INDEX | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| CONTROL PRESSURE RATIO | a | b | c | d | e | f | g | h | i | j | k | l | m | n | o | p | q | r | s | t |

ADAPTIVE HOT GAS BYPASS CONTROL FOR CENTRIFUGAL CHILLERS

BACKGROUND OF THE INVENTION

1. Field of the Invention

This invention relates generally to refrigerating systems or chilling systems, and more particularly, to an apparatus and method for controlling a hot gas bypass valve to eliminate or minimize surge in centrifugal liquid chilling systems.

2. Description of the Related Art

As is generally known, surge or surging is an unstable condition that may occur when compressors, such as centrifugal compressors, are operated at light loads and high pressure ratios. It is a transient phenomenon characterized by high frequency oscillations in pressures and flow, and, in some cases, a complete flow reversal through the compressor. Such surging, if uncontrolled, causes excessive vibrations and may result in permanent compressor damage. Further, surging causes excessive electrical power consumption if the drive device is an electric motor.

It is generally known that a hot gas bypass flow helps avoid surging of the compressor during low-load or partial load conditions. As the cooling load decreases, the requirement for hot gas bypass flow increases. The amount of hot gas bypass flow at a certain load condition is dependent on a number of parameters, including the desired head pressure of the centrifugal compressor. Thus, it is desirable to provide a control system for the hot gas bypass flow that provides optimum control and is responsive to the characteristic of a given centrifugal chiller system.

An hot gas bypass valve control in the prior art is an analog electronic circuit described in U.S. Pat. No. 4,248,055. This prior art control provides as its output a DC voltage signal that is proportional to the required amount of opening of the valve. This prior art method requires calibration at two different chiller operating points at which the compressor just begins to surge. As a consequence of this, a good deal of time is consumed performing the calibration and it requires the assistance of a service technician at the chiller site. Further, variation of flow is necessary for many applications, and therefore, repeated calibration of the control is required. Another disadvantage of the prior art method is that it makes the false assumption that the surge boundary is a straight line. Instead, it is often characterized by a curve that may deviate significantly from a straight line at various operating conditions. As a consequence of this straight line assumption, the hot gas bypass valve may open too much or too little. Opening the valve too much may result in inefficient operation, and opening it too little may result in a surge condition.

SUMMARY OF THE INVENTION

The advantages and purpose of the invention are set forth in part in the description that follows, and in part is obvious from the description, or may be learned by practice of the invention. The advantages and purpose of the invention is realized and attained by means of the elements and combinations particularly pointed out in the claims.

To attain the advantages and in accordance with the purpose of the invention, as embodied and broadly described herein, systems and methods consistent with this invention automatically calibrate a surge control of a refrigeration system including a centriftigal compressor, a condenser, pre-rotational vanes, a load, and an evaporator through which a chilled liquid refrigerant is circulated. The system or method comprises a number of elements. First, systems or methods consistent with this invention sense a presence of a surge condition, sense a head parameter representative of the head of the compressor, and sense a load parameter representative of the load. Second, systems or methods consistent with this invention store the head parameter and the load parameter when the surge condition is sensed as calibration data to be used by the control of the refrigeration system.

To attain the advantages and in accordance with the purpose of the invention, as embodied and broadly described herein, systems and methods consistent with this invention control a hot gas bypass valve in a refrigeration system including a centrifugal compressor, a condenser, pre-rotational vanes, and an evaporator through which a chilled liquid refrigerant is circulated. The system or method comprises a number of elements. First, systems or methods consistent with this invention sense a current pressure representative of the current pressure of the liquid refrigerant in the condenser, sense a current pressure representative of the current pressure of the liquid refrigerant in the evaporator, and sense a current position representative of the current position of the pre-rotational vanes. Second, systems or methods consistent with this invention control the operation of a hot gas bypass valve so as to avoid surging in the compressor in response to a comparison of the current condenser pressure, the current evaporator pressure, and the current vane position, or functions thereof, to stored calibration data.

The summary and the following detailed description should not restrict the scope of the claimed invention. Both provide examples and explanations to enable others to practice the invention. The accompanying drawings, which form part of the detailed description, show one embodiment of the invention and, together with the description, explain the principles of the invention.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

The following description of embodiments of this invention refers to the accompanying drawings. Where appropriate, the same reference numbers in different drawings refer to the same or similar elements.

Figure 1:
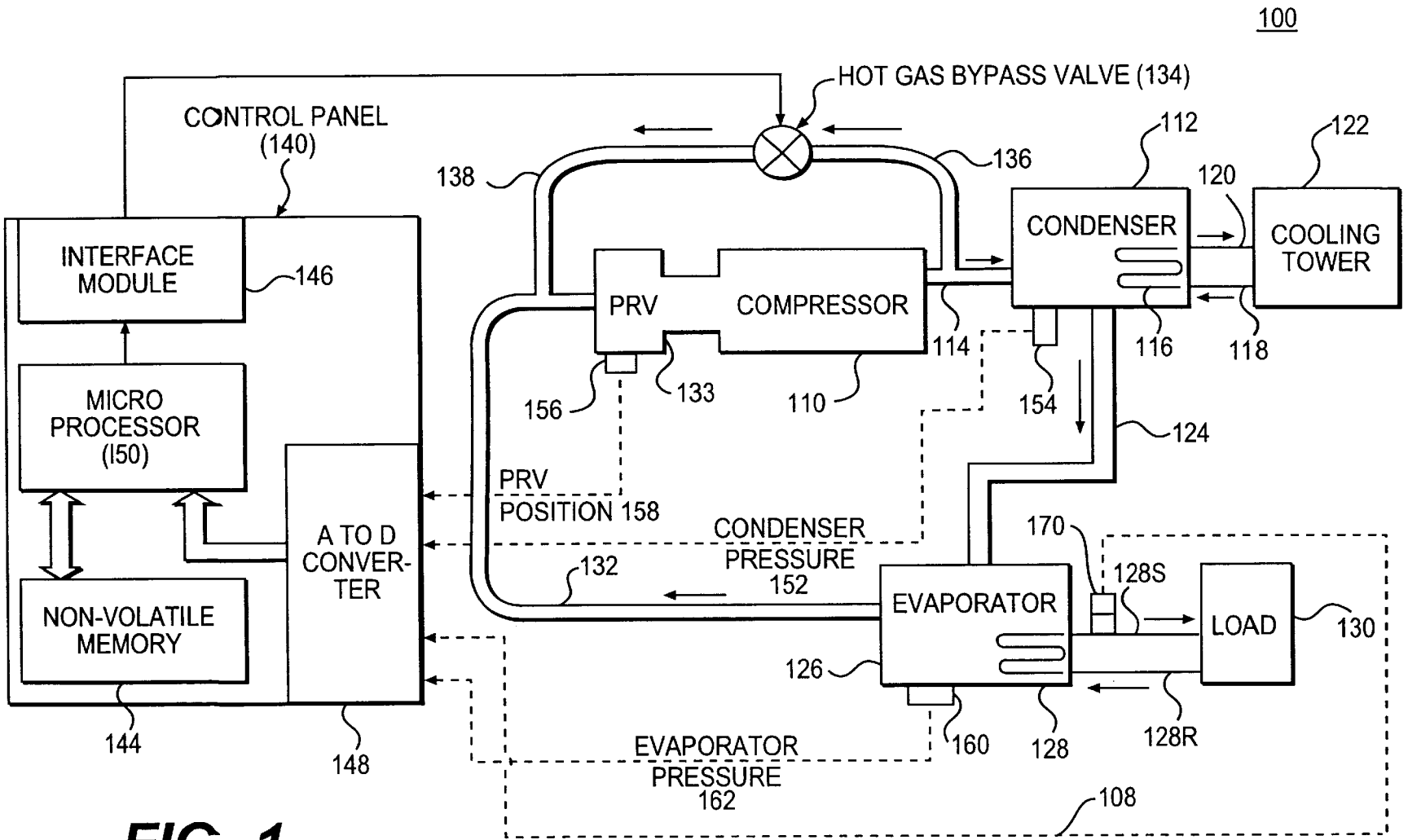
FIG. 1 is a diagram of a refrigeration system and control panel consistent with this invention.

FIG. 1 is a diagram of a refrigeration system 100 and control panel consistent with this invention. Refrigeration system 100 includes a centrifugal compressor 110 that compresses the refrigerant vapor and delivers it to a condenser 112 via line 114. The condenser 112 includes a heat-exchanger coil 116 having an inlet 118 and an outlet 120 connected to a cooling tower 122. The condensed liquid refrigerant from condenser 112 flows via line 124 to an evaporator 126. The evaporator 126 includes a heat-exchanger coil 128 having a supply line 128S and a return line 128R connected to a cooling load 130. The vapor refrigerant in the evaporator 126 returns to compressor 110 via a suction line 132 containing pre-rotational vanes (PRV) 133. A hot gas bypass (HGBP) valve 134 is interconnected between lines 136 and 138 which are extended from the outlet of the compressor 110 to the inlet of PRV 133.

A control panel 140 includes an interface module 146 for opening and closing the HGBP valve 134. Control panel 140 includes an analog to digital (A/D) converter 148, a microprocessor 150, a non-volatile memory 144, and an interface module 146.

A pressure sensor 154 generates a DC voltage signal 152 proportional to condenser pressure. A pressure sensor 160 generates a DC voltage signal 162 proportional to evaporator pressure. Typically these signals 152, 162 are between 0.5 and 4.5V (DC). A PRV position sensor 156 is a potentiometer that provides a DC voltage signal 158 that is proportional to the position of the PRV. A temperature sensor 170 on supply line 128S generates a DC voltage signal 168 proportional to leaving chilled liquid temperature. The four DC voltage signals 158, 152, 162, and 168 are inputs to control panel 140 and are each converted to a digital signal by A/D converter 148. These digital signals representing the two pressures, the leaving chilled liquid temperature, and the PRV position are inputs to microprocessor 150.

Microprocessor 150 performs with software all necessary calculations and decides what the HGBP valve position should be, as described below, as well as other functions. One of these functions is to electronically detect compressor 110 surge. Microprocessor 150 controls hot gas bypass valve 134 through interface module 146. Micro-processor 150 also keeps a record of PRV 133 position and pressure ratio in non-volatile memory 144 for each surge event, as described below. The conventional liquid chiller system includes many other features which are not shown in FIG. 1. These features have been purposely omitted to simplify the drawing for ease of illustration.

Methods and systems consistent with this invention self calibrate adaptively by finding the surge points as the chiller operates. This Adaptive hot gas bypass (Adaptive HGBP or AHGBP) process creates a surge boundary which represents the actual surge curve, not a linear approximation. This is accomplished by electronically detecting compressor surge when it takes place and storing in non-volatile memory 144 numerical values which represent the compressor head and chiller load when the surge takes place. In the preferred embodiment, the numerical values represent the control pressure ratio, as defined below, and PRV position for each detected surge condition. In this way, the control panel 140 remembers where surge took place and can take the appropriate action to prevent surge from occurring in the future by referencing the values stored in memory.

Different parameters can be used to represent the compressor head. For example, the method in U.S. Pat. No. 4,248,055 uses compressor liquid temperature (CLT) to represent compressor head. According to U.S. Pat. No. 4,282,719, which is incorporated by reference, the pressure ratio is a better representation of compressor head than the CLT. The pressure ratio is defined as the pressure of the condenser minus the pressure of the evaporator, that quantity divided by the pressure of the evaporator. While both CLT and pressure ratio can be used in the application of the present invention, the present preferred method is to detect and use the pressure ratio.

According to U.S. Pat. No. 4,248,055, the difference between the evaporator returning chilled water temperature (RCHWT) and leaving chilled water temperature (LCHWT) can be used to represent the chiller cooling load. While those parameters can be used with the broadest aspect of this invention, in the preferred embodiment this invention uses the pre-rotation vane (PRV) position to represent chiller cooling load. Use of the PRV position minimizes variations due to flow. Further, because the control is self-calibrating, applications in which full load corresponds to partial open vanes should not present a problem.

In the preferred embodiment, the method and system disclosed in U.S. Pat. No. 5,764,062, which is incorporated by reference, is used to detect a surge condition. When a valid surge event occurs, the process of the invention detects and/or determines the parameters of load and compressor head. Preferably, the process of the invention detects and determines the current PRV position and calculates the current pressure ratio, and then subtracts a small margin. According to the invention, data is organized relative to a PRV index value. For instance, a given PRV position is converted into a percentage from zero to 100%. A current PRV index value of 1 could represent a PRV percentage of zero to 5%. A current PRV index value of 2 could represent a PRV percentage of 5% to 10%, etc. This method of determining the PRV index is exemplary only. Another, preferred method is described below and in FIG. 6.

Figure 2:
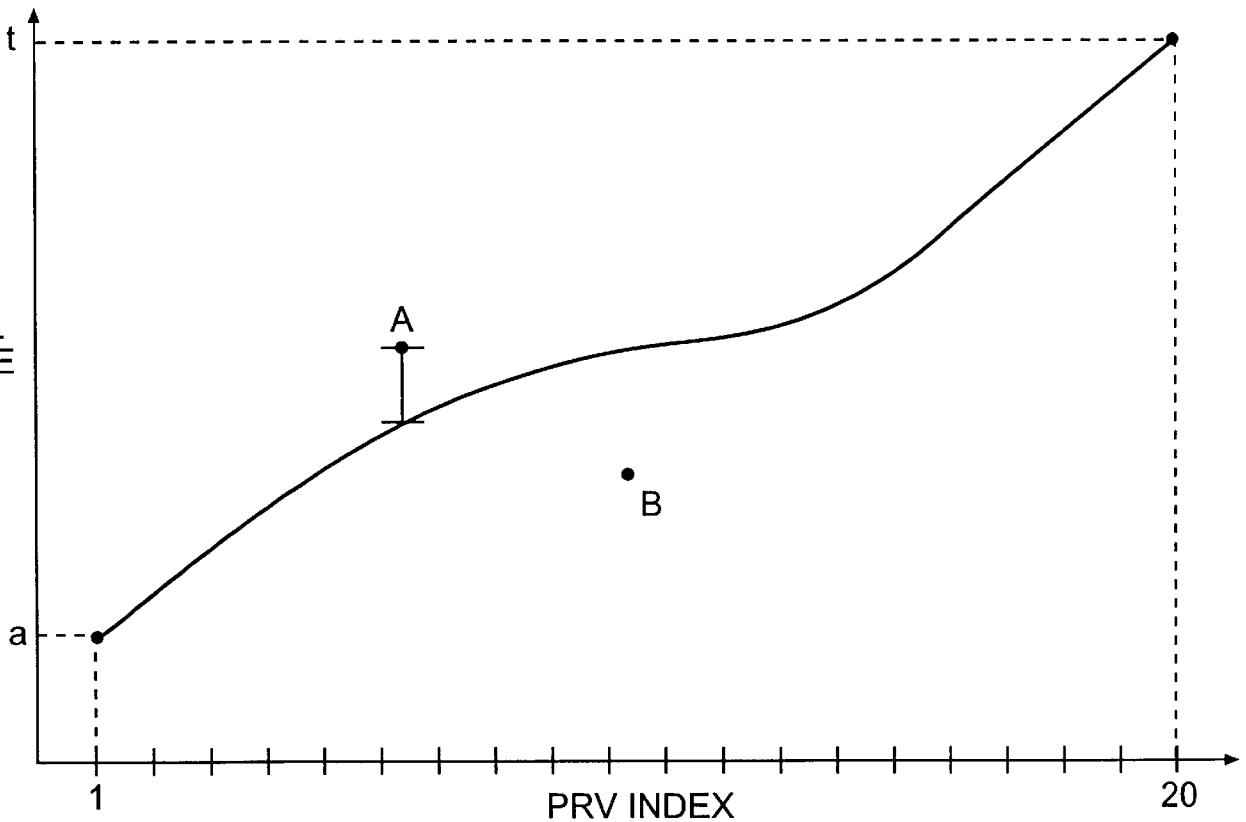
FIG. 2 is a diagram of a table that stores control pressure ratios and corresponding prerotational rotational vane position index and a plot of the values in the table, each consistent with this invention.

The process then accesses a table of all possible PRV index values. Each PRV index has one control pressure ratio associated to it. FIG. 2 shows an example of such a table and a plot of the PRV index versus the control pressure ratio. The PRV index ranges from 1 to 20, and the stored control pressure ratios are represented by the small letters 'a' through 't'. The slope of the curve in FIG. 2 is generally positive. The stored control pressure ratios correspond to the sensed pressure ratios for a given PRV index value, minus a small preselected margin. This table is stored in non-volatile memory 144. Alternatively, the table can store other information such as the evaporator pressure, the condenser pressure, the PRV position, among other data that may be useful for determining the conditions under which surge takes place.

If a surge is detected at a given PRV position and no control pressure ratio is stored at the PRV index value corresponding to that PRV position, the process stores the current pressure ratio, minus a small margin, as the stored control pressure ratio at that PRV index. The small margin is defined by the user and is programmable through control panel keypad.

The hot gas bypass valve is opened or closed based on a comparison of periodically sensed values of the current pressure ratios with a stored control pressure ratio in the table, at a given PRV index. If the current pressure ratio is greater than the stored control pressure ratio, the HGBP valve 134 is opened by an amount proportional (by using a proportion coefficient) to the difference between the current pressure ratio and the stored control pressure ratio. This corresponds to operating point A in FIG. 2. The proportion coefficient may be programed through control panel 140. As time progresses, if the current pressure ratio increases above the stored control pressure ratio stored in the table, the HGBP valve 134 is opened further to eliminate surge. The valve 134 starts to close as the current pressure ratio decreases toward the stored control pressure ratio in the table.

If the current pressure ratio is less than or equal to the stored value in the table, the valve 134 remains closed because this corresponds to normal operation. This corresponds to operating point B in FIG. 2.

If the characteristics of the system changes so that compressor 110 surges while operating at a point on or below the curve in FIG. 2, the stored control pressure ratio in the table is decreased incrementally. This automatically causes the HGBP valve 134 to open more in order to stop surge. Once the surge condition has ceased the final value stored in the table represents the new surge boundary associated with that PRV index. Instead of decreasing the stored control pressure ratio, it is possible to increase the proportion coefficient, which would also automatically cause the HGBP valve 134 to open more in order to stop a surge. Under other circumstances, it is possible that the system characteristics can change so that it would be beneficial to increase the stored control pressure ratios instead of decreasing them. In this situation, it is possible to adaptively increase the stored control pressure ratios by control methods well known in the art.

The above process continues as chiller load conditions change and therefore is self calibrating. In this way, the table of stored control pressure ratios is created, revised and maintained and reflects where the surge boundary is at a given time so that HGBP valve 134 is opened and closed at the appropriate chiller operating points. The table may not necessarily store a control pressure ratio point for each PRV index because the vanes may not operate above partially open conditions for some applications. For instance, the PRV percentage may never reach 95 to 100% and thus PRV index value of 20 may not have a stored control pressure ratio associated to it. On the other hand, if a surge is detected at a PRV index with no stored control pressure ratio, the sensed pressure ratio is used to create a stored control pressure ratio (by slightly decreasing the sensed ratio).

Figure 3A:
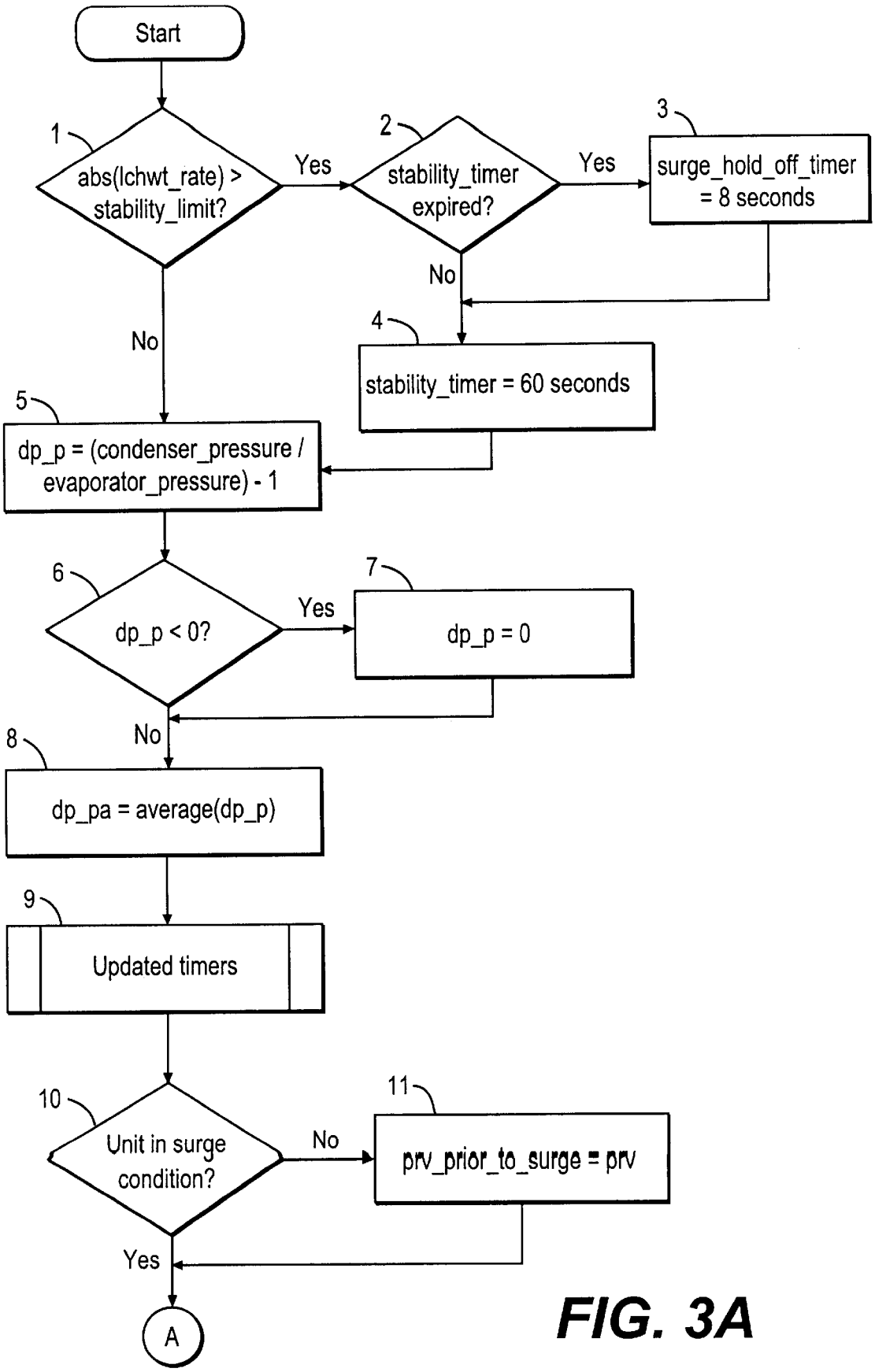
FIGS. 3A, 3B, 3C are a flow diagram of the Adaptive Hot Gas Bypass control process consistent with this invention.
Figure 3B:
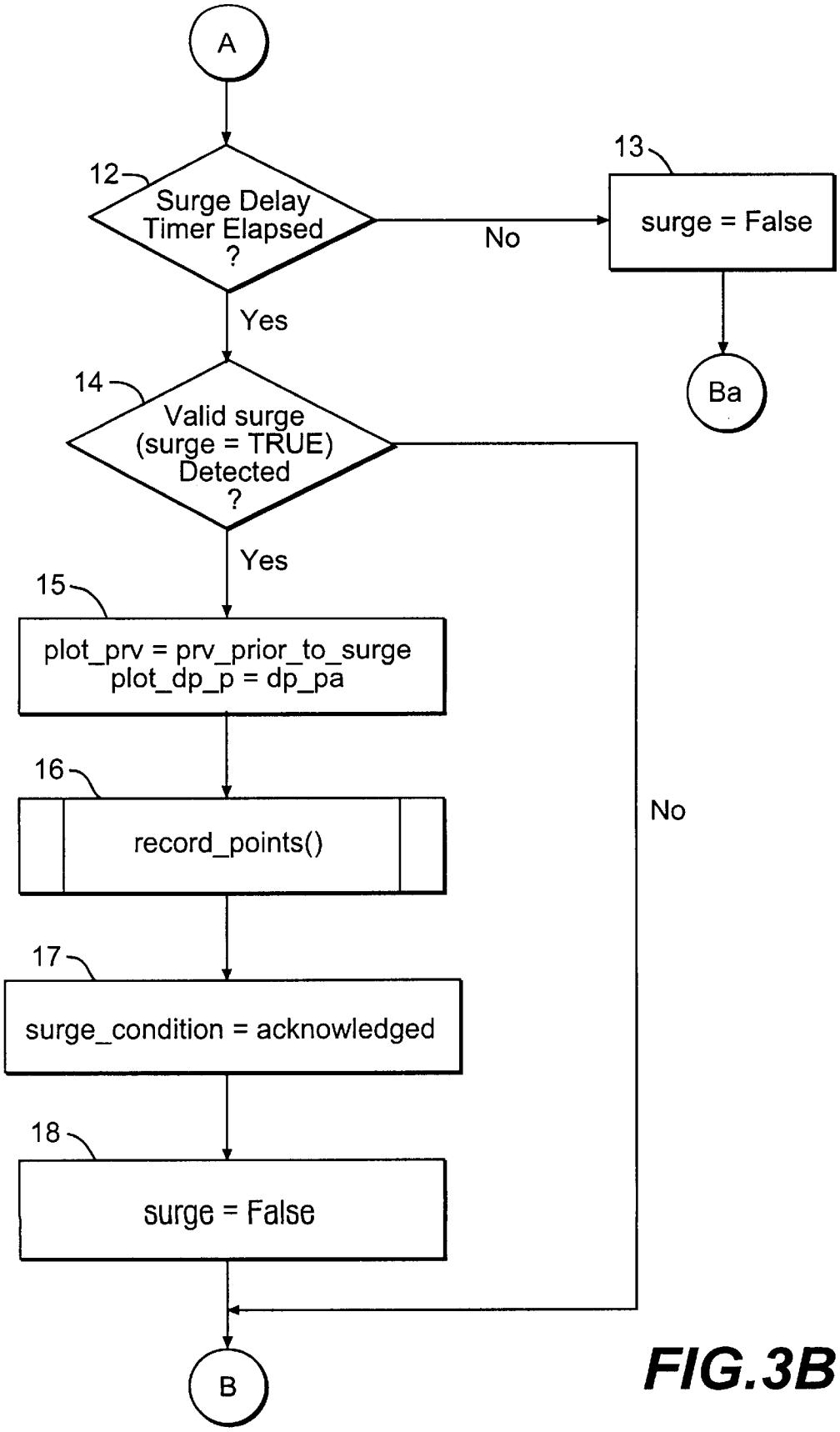
Figure 3C:
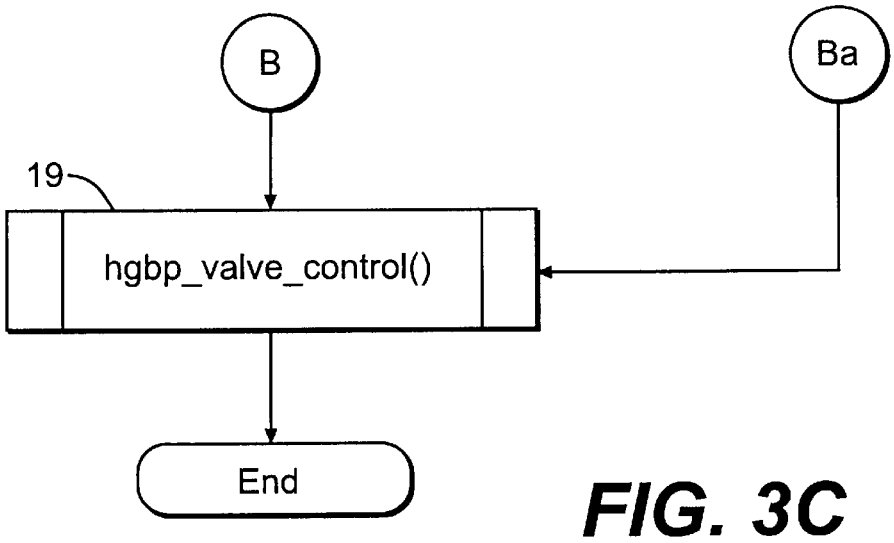

FIGS. 3A, 3B, and 3C show a flow chart of the AHGBP control process consistent with this invention. This flow chart, and ones that follow, contain variables and constants, which are included in parentheses in the description below.

Microprocessor 150 executes the AHGBP control process once per second, although it is not limited to this particular period of time. When the AHGBP control process starts, the absolute value of the leaving chilled water 128S temperature (LCHWT) rate of change ($lchwt_{13}$ rate) is compared to the programmable stability limit (stability_limit) (step 1). Temperature sensor 170 measures the LCHWT. The stability limit, if exceeded, represents a dynamic condition that invalidates storing control pressure ratios. If the LCHWT rate is greater than the stability limit (step 1), then the stability timer (stability_timer) is checked (step 2). In the preferred embodiment, the stability limit is 0.3° F. per second. If the timer has expired (step 2), then a surge hold-off timer (surge_hold_off_timer) is started (step 3) in order to create a window of time for storing control pressure ratios in the case where a surge creates the unstable LCHWT condition. Control pressure ratios are stored in a sub-process discussed below and shown in FIGS. 4A, 4B, 4C. The surge hold-off and stability timers are checked in that sub-process. The stability timer is reset to its starting time (step 4) in order to assure that a time delay has occurred after the unstable condition has subsided.

Next, the current pressure ratio (dp_p) is assigned the value of ((Condenser Pressure/Evaporator Pressure)−1), which is equal to ((condenser pressure -evaporator pressure)/evaporator pressure) (step 5). The pressure ratio should only have positive numbers. Therefore, if the pressure ratio is negative (step 6), it is assigned the value of zero (step 7). Next, the average pressure ratio (dp_pa), is assigned the average value of the past N pressure ratios, including the current pressure ratio (step 8). In the preferred embodiment, N is equal to ten. Averaging the pressure ratio prevents erroneous values from fluctuations due to surges. Then, the timers used in this process are updated (step 9). Updating the timers involves decreasing their values until they reach zero.

While this AHGBP process is executed, a separate surge detection process continuously detects whether surge conditions are present in compressor 110. As stated above, the preferred method of detecting surge conditions is discussed in U.S. Pat. No. 5,764,062. When the surge detection process detects a surge condition, it then "validates" the surge condition. A "valid" or "validated" surge is not only when surge conditions are present, but when there is a high confidence that a surge is actually occurring. When the surge detection process detects a valid surge, it flags it by setting a variable (surge) to TRUE.

If surge conditions are not detected in the compressor (validated or not) (step 10), the PRV position (prv) is stored in a memory buffer location (prv_prior_to_surge) (step 11) to provide an accurate indicator of the PRV position prior to surge. If surge conditions are detected in the compressor (validated or not) (step 10), the PRV position stored in this memory buffer location remains what it was at the beginning of the surge condition.

Next, if the surge delay timer has elapsed (step 12), the validity of the surge condition is checked (step 14). The surge delay timer prevents overwriting the previously stored control pressure ratios if another surge occurs immediately after the present surge. Therefore, the timer provides a time period that allows the system to adjust to action taken by the by the process to the original surge. This timer is discussed and initialized in a sub-processes described below and in FIGS. 4A, 4B, and 4C. If a valid surge is detected (surge= TRUE), the values of the PRV position prior to surge (prv_prior_to_surge) and average pressure ratio (dp_pa) are stored in temporary variable locations (plot_prv and plot_dp_p, respectively) (step 15). If conditions permit, they are recorded, i.e. stored in the table (step 16), which is explained in detail below and in FIGS. 4A, 4B, and 4C. The surge condition (surge_condition) is acknowledged (step 17) by indicating this on the control panel user display. Then, the surge flag is cleared (FALSE) (step 18). Finally, the Hot Gas Bypass Valve sub-process is performed (step 19), which is described below and in FIGS. 5A, 5B, and 5C. The HGBP Valve sub-process determines the amount of valve opening or closing.

If the surge delay timer has not elapsed (step 12), the surge flag is cleared (FALSE) (step 13) and the Hot Gas Bypass Valve sub-process is performed (step 19). The surge flag is cleared step 13 and 18) because the AHGBP process took action or is currently taking action to take the system out of any validated surge. The surge detection process, discussed above, will set the surge flag (surge) if necessary.

Figure 4A:
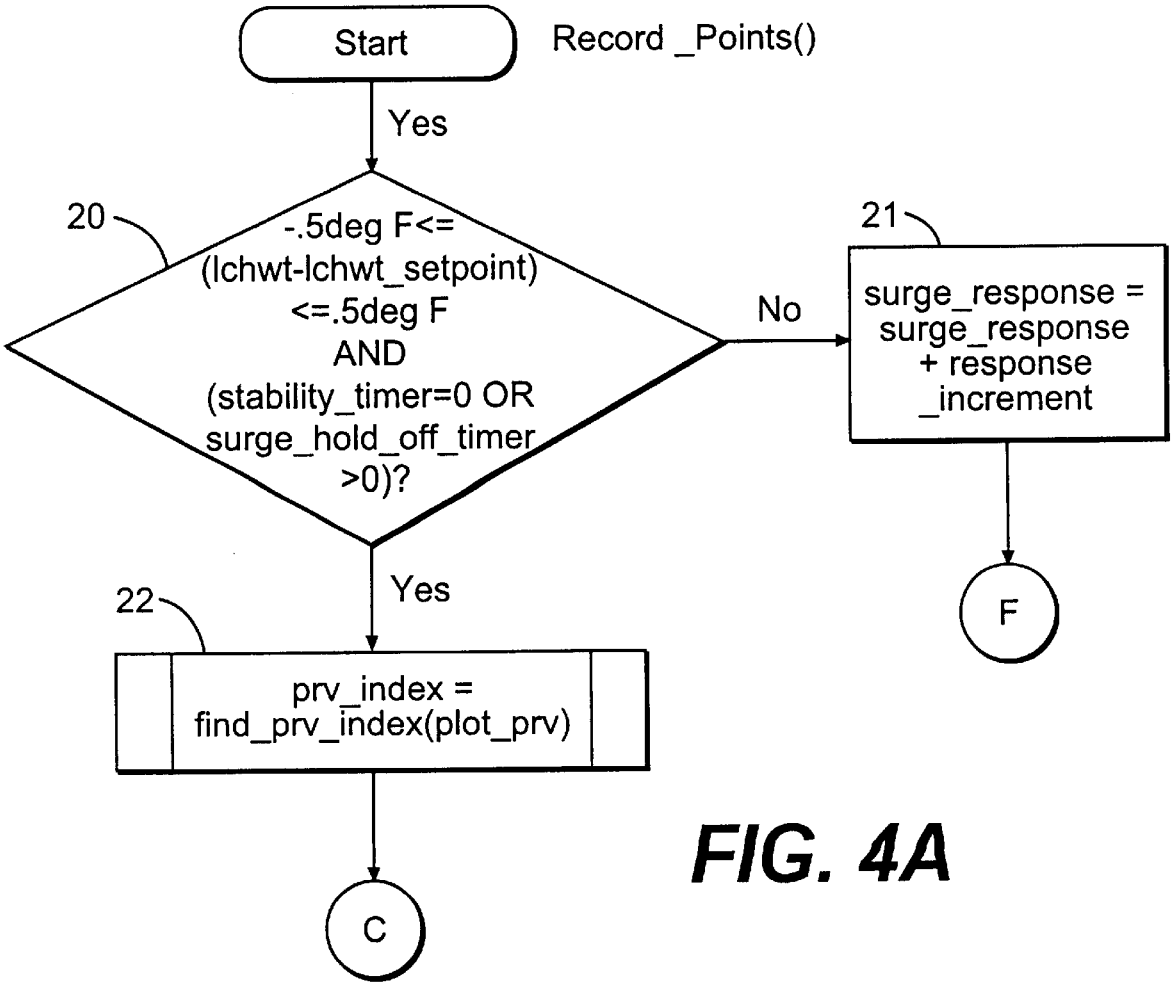
FIGS. 4A, 4B, 4C are a flow diagram for the sub-process of recording or storing control pressure ratios in a table as shown in FIG. 2.
Figure 4B:
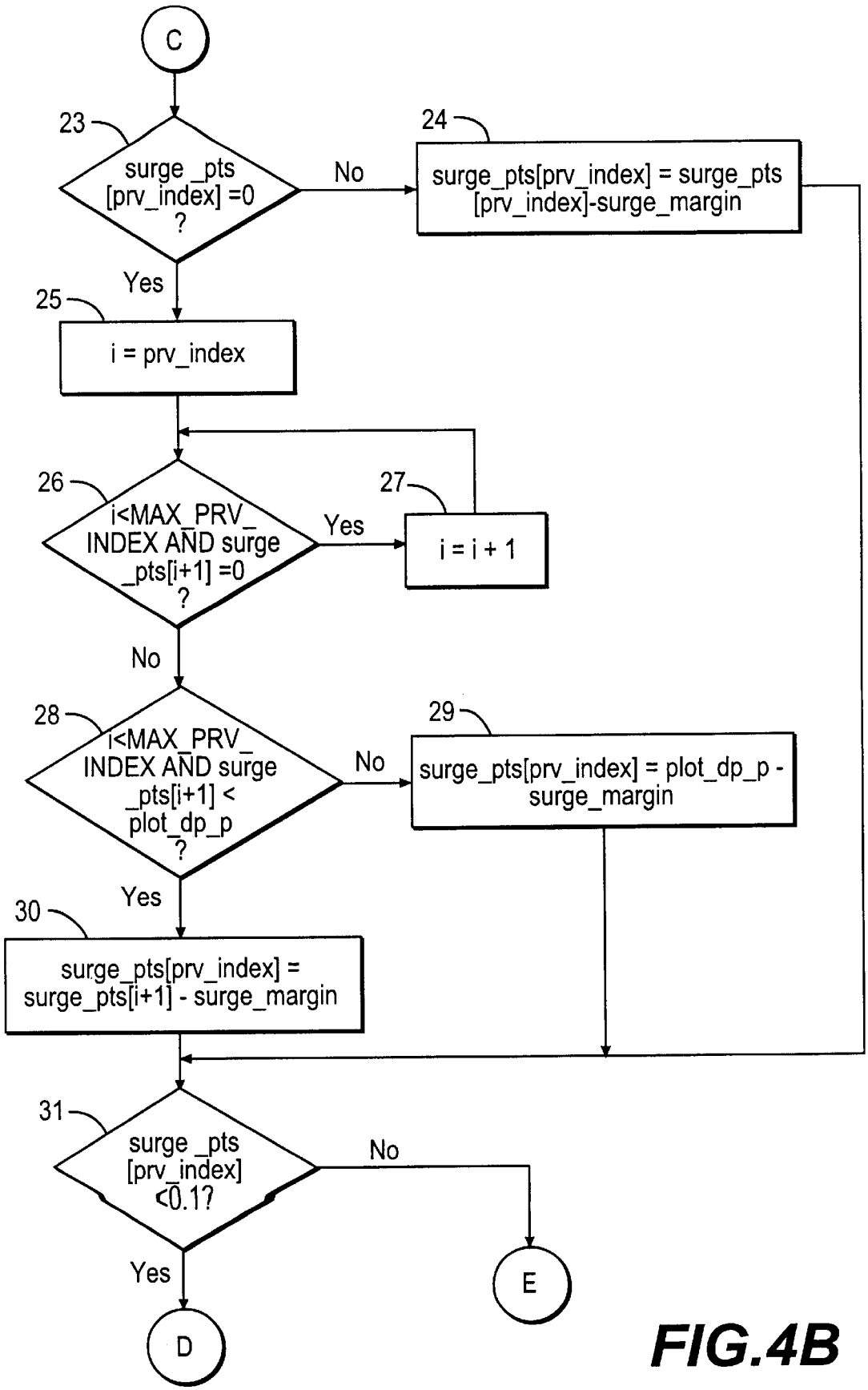
Figure 4C:
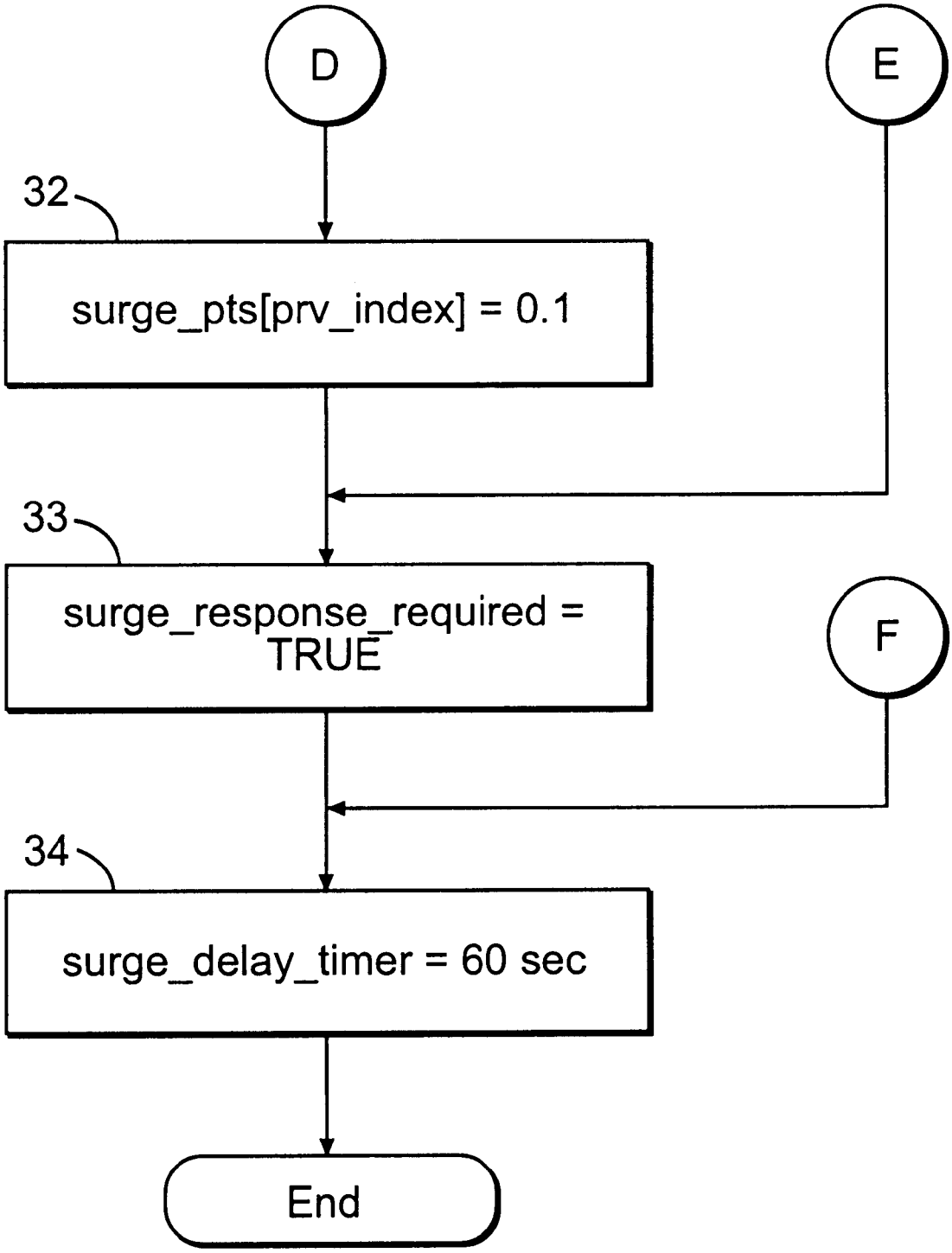

The point recording sub-process (step 16) is described in FIGS. 4A, 4B, and 4C. This process executes whenever a valid surge is detected (step 14). This process takes the PRV position before surge (plot_prv) and the average pressure ratio (plot_dp_p) and stores them as control parameters into a table, such as one shown in FIG. 2, if the appropriate qualifications are met.

First, the process checks if the system conditions are stable and the LCHWT is operating at set-point. It does this by checking whether the current LCHWT is within plus or minus 0.5° F. of its set-point (setpoint) and the temperature control has been stable for 60 seconds (stability timer) or it is within 8 seconds of the start of new unstable LCHWT condition (surge hold-off timer) (step 20). If these conditions are met, then the current PRV index (prv_index) is assigned a value based on the PRV position just before the surge event (step 22). The stability timer (stability_timer) and the surge hold-off timer (surge_hold_off_timer) are described above and in FIGS. 2A, 2B and 2C. The set-point is a temperature programmed by the user through the control panel 140. In the preferred embodiment, the set-point temperature is 44° F. Calculation of the PRV index is described in more detail in FIG. 6 below.

Next, if no control pressure ratio is stored in the table at the current PRV index (surge_pts[prv_index]) (step 23) (a zero means that no control pressure ratio has been stored), the process searches for a stored control pressure ratio with a higher PRV index. (steps 25, 26, and 27). The process does not search beyond the maximum PRV index value (MAX_PRV_INDEX). In the preferred embodiment, the PRV index ranges from zero to a maximum of 15.

If there is a higher PRV index with a previously stored control pressure ratio and it is less than the average pressure ratio temporarily stored (plot_dp_p) (step 28), the process assigns the table position at the current PRV index (prv_index) the value at the higher PRV index minus a programmable margin (surge_margin) (step 30). This serves as a precaution against storing a value which is greater than any value at a higher PRV index because in the preferred embodiment the curve should have a positive slope, as shown in FIG. 2.

If there is no higher PRV index that has a previously stored control pressure ratio (step 28), or it is greater than or equal to the average pressure ratio temporarily stored (plot_dp_p) (step 28), the process assigns the control pressure ratio at the current PRV index (prv_index) with the average pressure ratio value temporarily stored (plot_dp_p) minus the programmable margin (surge_margin) (step 29). This stored control pressure ratio is now the stored control pressure ratio corresponding to that PRV index. In the preferred embodiment, the value of the programmable margin is between 0.1 and 0.5.

If a control pressure ratio is stored in the table (step 23), then the process subtracts from this value the programmable margin (surge_margin) (step 24). In this case, the process is adapting and re-calibrating to changed system conditions, as explained above. In all cases, the minimum value a control pressure ratio may have is 0.1. If the actual value is below 0. 1, the control pressure ratio is assigned the value of 0.1 (steps 31, 32). An average pressure ratio of 0.1 or less is well below what would ordinarily be calculated and is used merely as a precaution to prevent a zero from possibly being placed in the table (because a zero indicates that a control pressure ratio is not entered into the table at that PRV index). At this time, a surge response is required (step 33), and is flagged (surge_response_required), i.e. the HGBP valve needs to be opened to stop surge.

If the LCHWT condition is not met and the temperature conditions are not met (step 20), then the unit conditions are not stable or the LCHWT is not operating at set-point. In this case, a control value should not be stored in memory, but a surge response is still needed (independent of the surge response required flag, discussed above). Therefore, the process adds a programmable response increment (response_increment) to the surge response (surge_response) (step 21). The surge response is the amount the HGBP valve is opened in order to stop surge, and its value is determined in the HGBP valve control sub-process explained below and in FIGS. 5A, 5B, and 5C. In all cases, the process sets a surge delay timer (step 34) so that no control pressure ratios are stored in memory before the system has a chance to respond to the HGBP valve response.

Figure 5A:
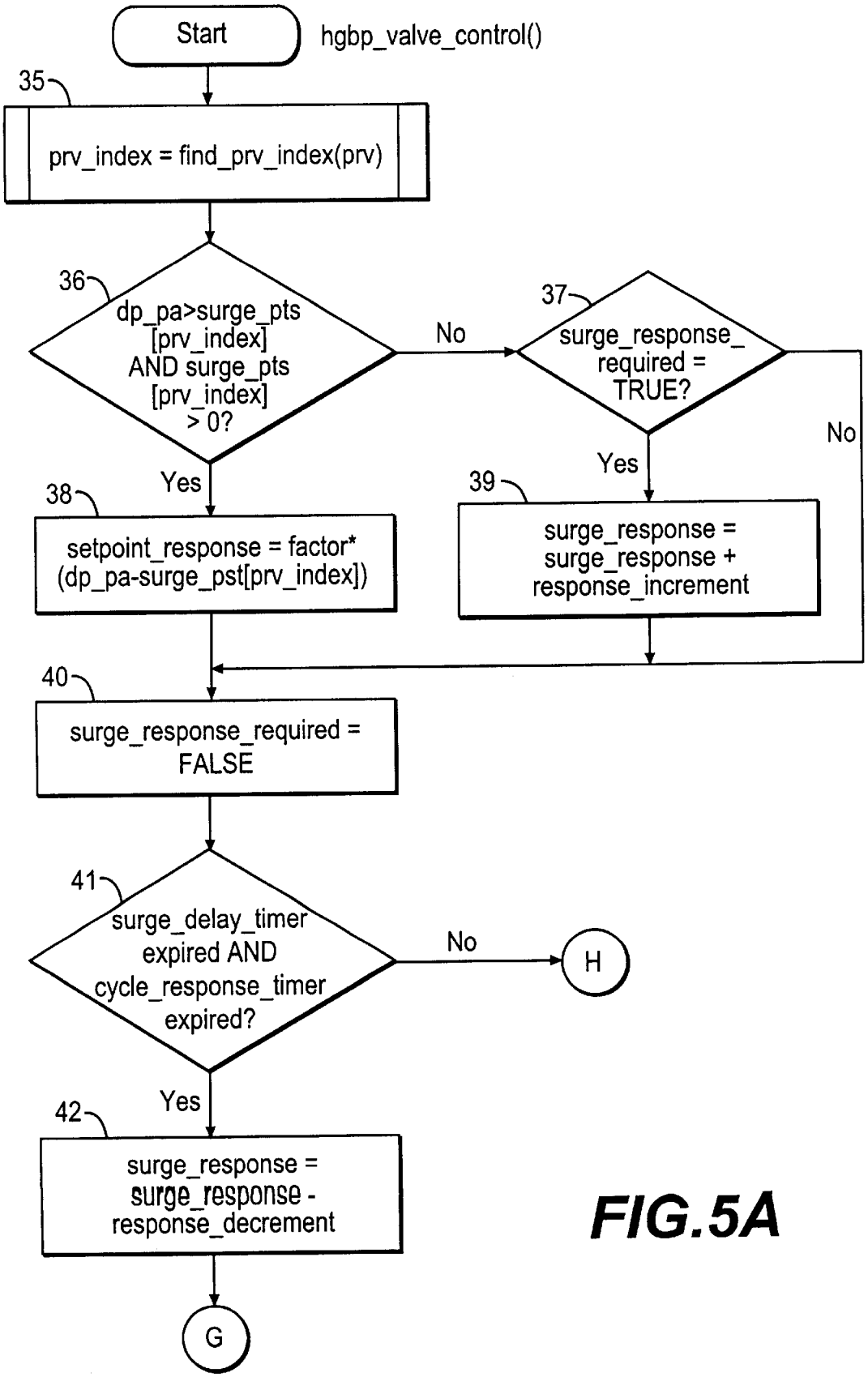
FIGS. 5A, 5B, 5C are a flow diagram for a hot gas bypass valve control sub-process consistent with this invention.
Figure 5B:
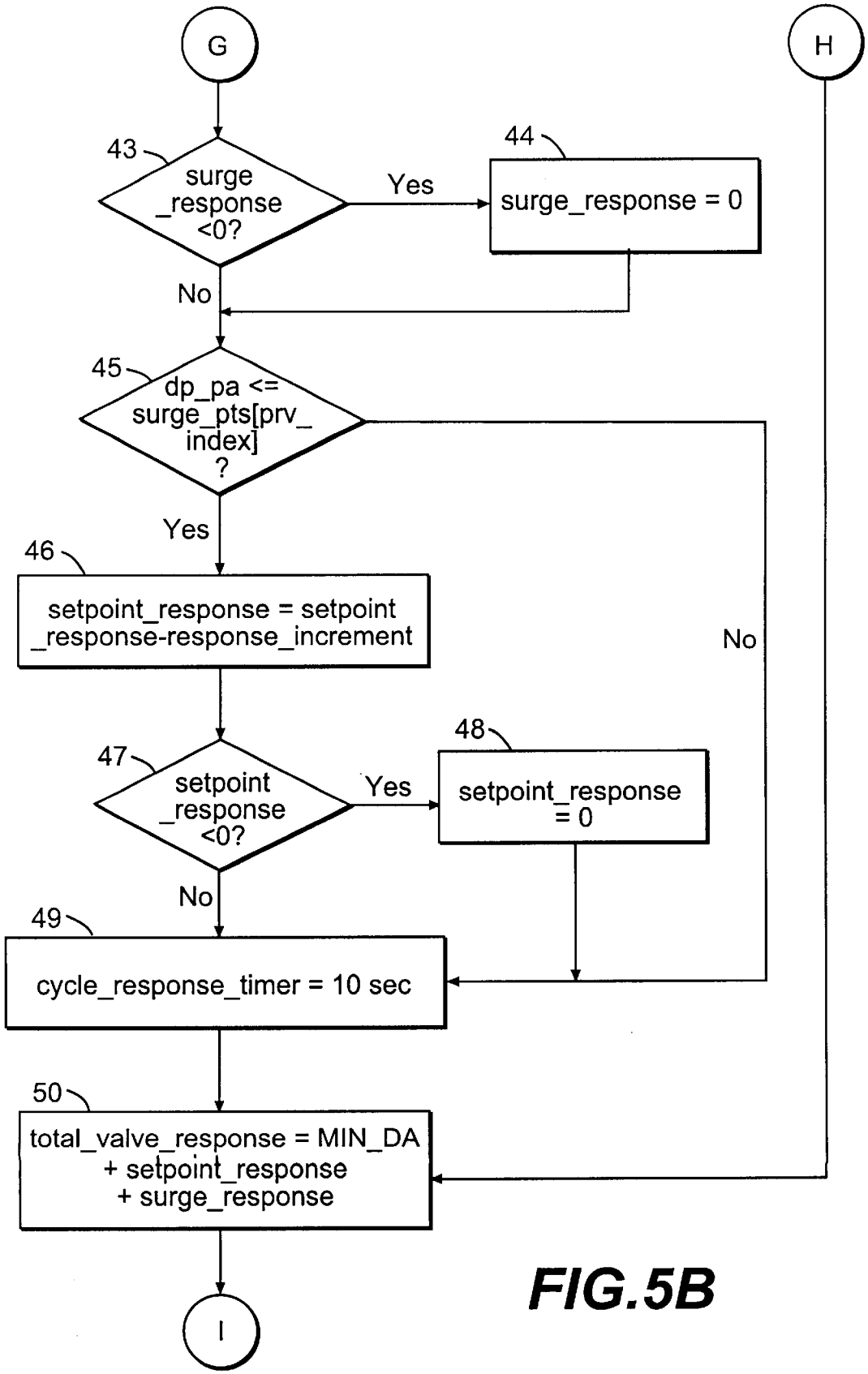
Figure 5C:
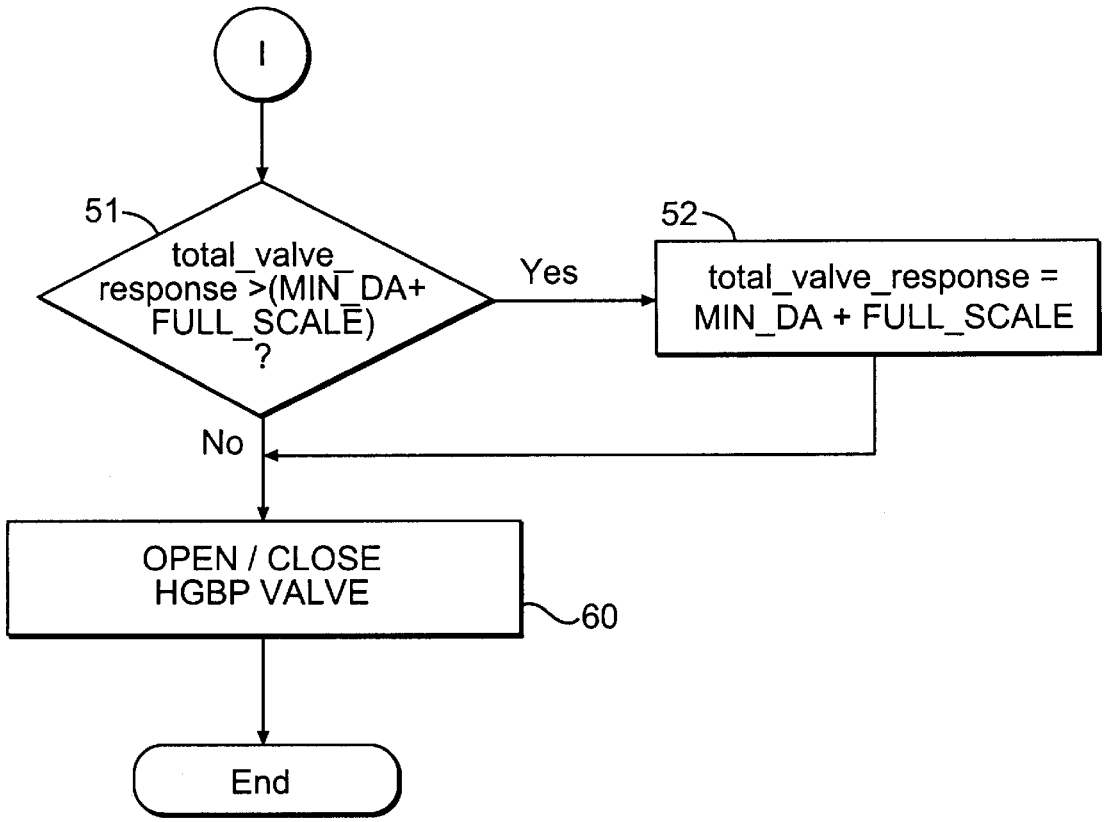

The HGBP valve control sub-process (step 19) is described in more detail in FIGS. 5A, 5B, and 5C. This sub-process determines the valve response comprising how much the valve should be opened or closed. Three terms contribute to the total valve response. The first term, the set-point response, is proportional to the current pressure ratio minus the control pressure ratio at the current PRV index. The second term, the surge response, is the amount the HGBP valve is opened in response to surge. This term is exclusive of the set-point response and always returns to zero during normal non-surge conditions.

The third term is the minimum digital to analog converter (DAC) response. The interface module 146 comprises the DAC, which is necessary to control signals to the HGBP valve 134. The DAC has a minimum value (DA_MIN) it can receive, which corresponds to the closed HGBP valve position. Thus, the total valve response is equal to the set-point response plus the surge response plus the minimum DAC response.

First, the PRV index is assigned a value indicative of the current PRV position (prv) (step 35). Assigning the PRV index is explained in more detail below and in FIG. 6. If the PRV index contains a previously stored control pressure ratio, and the current average pressure ratio is greater than that value (step 36), then the set-point response is assigned the value of a proportion coefficient (factor) multiplied by the difference of the two values (step 38). In other words, a response is taken that opens the HGBP valve by an amount proportional to the difference between average pressure ratio and the stored control pressure ratio at the current PRV index. The proportion coefficient is programmable through control panel 140 and preferably ranges from 10 to 100.

If either a control pressure ratio is not assigned for the current PRV index or the average current pressure ratio is less than the stored value at that PRV index (step 36), the process checks if a surge response requirement is flagged (surge_response_required) (step 37) because no set-point response will take place. If a surge response is required (step 37), then the surge response (surge_response) is incremented (surge_response increment) (step 39). Preferably, the surge response increment is 5% of the full scale, but it is not limited to this.

In all cases, the surge response required flag is cleared (step 40) because no further surge response is necessary until another valid surge takes place. If the surge delay timer and the cycle response timers (cycle_response_timer) are expired (step 41), the surge response component of the HGBP valve control is slowly lowered (step 42) by a preset amount (response_decrement) toward zero to determine whether surge occurs again. The cycle response timer prevents the HGBP valve from opening or closing too quickly by only allowing valve movement in periodic intervals. This preset amount (response_decrement) is preferably 1% of the full scale. In this way, the HGBP valve position is optimized by only allowing the set-point response component of the HGBP control to ultimately contribute to the valve opening in the steady state.

The surge response should not be negative. Therefore, if the surge response is below zero (step 43), it is set to zero (step 44). If the current average pressure ratio is less than or equal to the stored control pressure ratio at the PRV index value (step 45), the process subtracts the response increment from the set-point response (step 46) so that the HGBP valve is slowly moved to its closed position.

The set-point response should also not be negative. Therefore, if the set-point response is below zero (step 47), the process sets the set-point response to zero (step 48). The cycle response timer (cycle_response_timer) is reset (step 49) so that this portion of the HGBP valve process is executed once every 10 seconds.

The total valve response (total_value_response) is equal to the set-point response plus the surge response plus the minimum DAC value (DA_MIN) (step 50). The DAC has a minimum value it can receive (DA_MIN), which corresponds to a closed valve position. The maximum the total valve response allowed is the full scale DAC range value (FULL_SCALE) plus the minimum DAC value (step 51,52). The process then opens or closes the HGBP valve (step 60) in response to the total valve response necessary by means of interface module 146.

Figure 6:
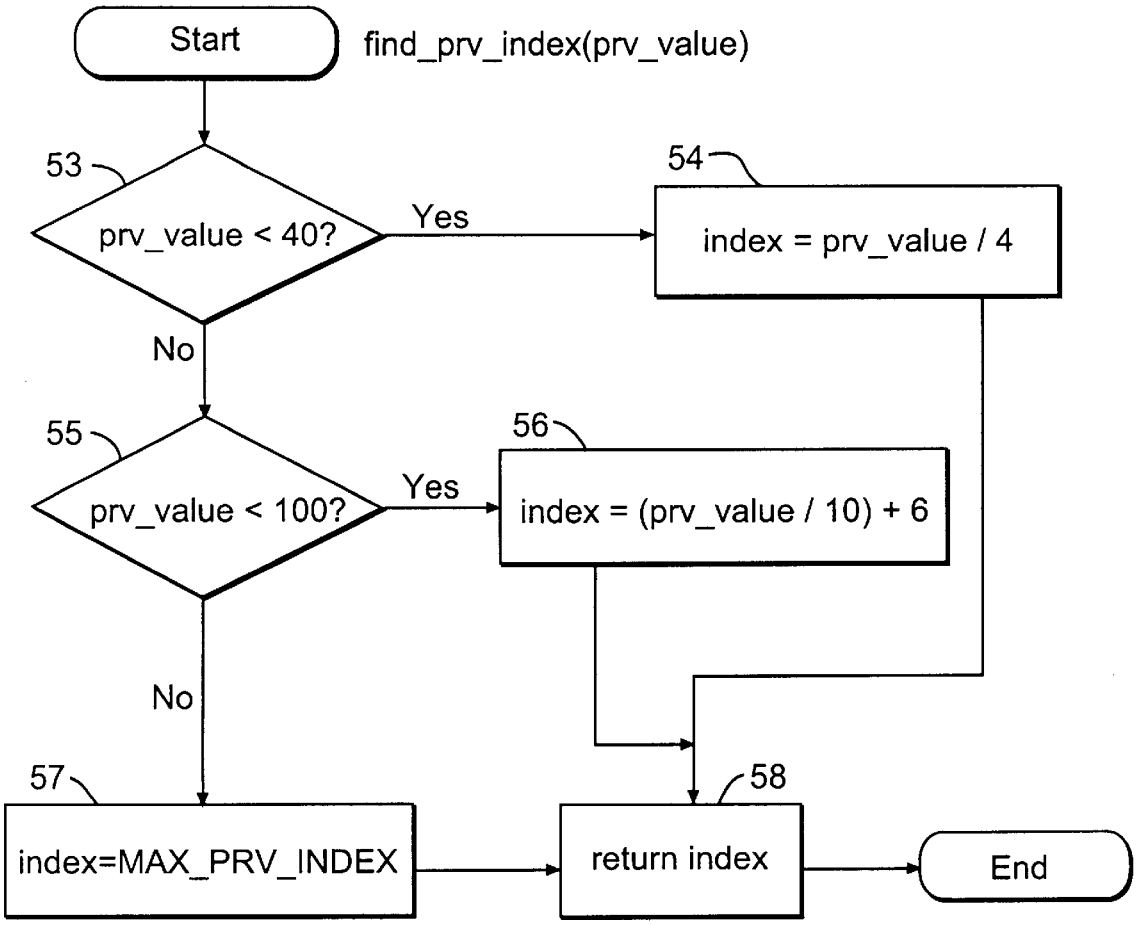
FIG. 6 is a flow diagram for a sub-process for determining the PRV index shown in of FIG. 2.

FIG. 6 is a flow chart of a sub-process for determining the PRV index (prv_index) for the stored control pressure ratios. If the PRV value (prv_value) is less than 40% (step 53), then the index value returned (step 58) is the PRV value divided by four (step 54). If the PRV value is not less than 40% (step 53), but is less than 100%, then the index returned (step 58) is the PRV value divided by ten, plus six. If the PRV value is not less than 100% (step 55) then the index returned (step 58) is the maximum value allowed (MAX_PRV_INDEX). In the preferred embodiment, the maximum value allowed is 15, the PRV value ranges between zero and 100%.

The specification does not limit the invention. Instead it provides examples and explanations to allow persons of ordinary skill to appreciate different ways to practice this invention. The following claims define the true scope and spirit of the invention.

What is claimed is:

1. A method for automatically calibrating a surge control of a refrigeration system including a centrifugal compressor, a condenser, pre-rotational vanes, a load, and an evaporator through which a chilled liquid refrigerant is circulated, said method comprising:

sensing a presence of a surge condition;

sensing a head parameter representative of the head of the compressor;

sensing a load parameter representative of the load; and storing the head parameter and the load parameter when the surge condition is sensed as calibration data to be used by the control of the refrigeration system;

sensing a present head parameter representative of the present head of the compressor;

sensing a present load parameter representative of the present load; and controlling the operation of a hot gas bypass valve so as to avoid surging in the compressor in response to the present head parameter, the present load parameter, and the stored control calibration data.

2. The method of claim 1, wherein sensing the head parameter includes sensing a pressure representative of the pressure of the liquid refrigerant in the condenser;

sensing a pressure representative of the pressure of the liquid refrigerant in the evaporator;

calculating a differential pressure equal to the difference between the condenser pressure and the evaporator pressure; and calculating a pressure ratio equal to the ratio between the calculated differential pressure and the evaporator pressure.

3. The method of claim 1, wherein sensing the load parameter includes sensing a position representative of the position of the pre-rotational vanes.

4. The method of claim 1, wherein sensing the head parameter includes sensing a pressure representative of the pressure of the liquid refrigerant in the condenser;

sensing a pressure representative of the pressure of the liquid refrigerant in the evaporator;

calculating a differential pressure equal to the difference between the condenser pressure and the evaporator pressure; and calculating a pressure ratio equal to the ratio between the calculated differential pressure and the evaporator pressure; and wherein sensing the load parameter includes sensing a position representative of the position of the pre-rotational vanes.

5. The method of 4, wherein storing the head parameter includes storing the pressure ratio, minus a small margin, as a stored control pressure ratio when the surge condition is sensed; and storing the corresponding vane position as a stored control vane position when the surge condition is sensed.

6. The method of claim 1, wherein sensing the present head parameter includes sensing a present pressure representative of the present pressure of the liquid refrigerant in the condenser;

sensing a present pressure representative of the present pressure of the liquid refrigerant in the evaporator;

calculating a present differential pressure equal to the difference between the present condenser pressure and the present evaporator pressure; and calculating a pressure ratio equal to the ratio between the present calculated differential pressure and the present evaporator pressure.

7. The method of claim 1, wherein sensing the present load parameter includes sensing a present position representative of the present position of the pre-rotational vanes.

8. The method of claim 1, wherein sensing the present head parameter includes sensing a present pressure representative of the present pressure of the liquid refrigerant in the condenser;

sensing a present pressure representative of the present pressure of the liquid refrigerant in the evaporator;

calculating a present differential pressure equal to the difference between the present condenser pressure and the present evaporator pressure;

calculating a present pressure ratio equal to the ratio between the present calculated differential pressure and the present evaporator pressure; and sensing a present position representative of the present position of the pre-rotational vanes.

9. The method of claim 8, wherein the stored control calibration data includes a stored control pressure ratio and a stored control vane position, said method including opening the hot gas bypass valve, if the current pressure ratio is greater than the stored control pressure ratio corresponding to the stored control vane position equal to the current vane position, by an amount proportional to a difference between the current pressure ratio and the stored control pressure ratio.

10. The method of claim 8 wherein the stored calibration data includes a stored control pressure ratio and a stored control vane position, said method including closing completely the hot gas bypass valve, if the current pressure ratio is less than or equal to the stored control pressure ratio corresponding to the stored control vane position equal to the current vane position.

11. A method for controlling a hot gas bypass valve in a refrigeration system including a centrifugal compressor, a condenser, pre-rotational vanes, and an evaporator through which a chilled liquid refrigerant is circulated, said method comprising:

sensing a present pressure representative of the present pressure of the liquid refrigerant in the condenser;

sensing a present pressure representative of the present pressure of the liquid refrigerant in the evaporator;

sensing a present vane position representative of the present position of the pre-rotational vanes; and controlling the operation of the hot gas bypass valve so as to avoid surging in the compressor in response to the present condenser pressure, the present evaporator pressure, and the present vane position to stored calibration data.

12. The method of claim 11, wherein controlling the operation includes calculating a present differential pressure equal to the difference between the present condenser pressure and the present evaporator pressure; and calculating a present pressure ratio equal to the ratio between the present calculated differential pressure and the present evaporator pressure.

13. The method of claim 11, wherein stored calibration data includes stored control pressure ratios and stored control vane position, said method including opening the hot gas bypass valve, if the present pressure ratio is greater than the stored control pressure ratio corresponding to the stored control vane position equal to the present vane position, by an amount proportional to a difference between the present pressure ratio and the stored control pressure ratio.

14. The method of claim 11, wherein stored calibration data includes stored control pressure ratios corresponding stored control vane positions, said method including closing completely the hot gas bypass valve, if the present pressure ratio is less than or equal to the stored control pressure ratio corresponding to the stored control vane position equal to the present vane position.

15. An apparatus for automatically calibrating a surge control of a refrigeration system including a centrifugal compressor, a condenser, pre-rotational vanes, a load, and an evaporator through which a chilled liquid refrigerant is circulated, said method comprising:

means for sensing a presence of a surge condition;

means for sensing a head parameter representative of the head of the compressor;

means for sensing a load parameter representative of the load;

means for storing the head parameter and the load parameter when the surge condition is sensed as calibration data to be used by the control of the refrigeration system;

means for sensing a present head parameter representative of the present head of the compressor;

means for sensing a present load parameter representative of the present load; and means for controlling the operation of a hot gas bypass valve so as to avoid surging in the compressor in response to the present head parameter, the present load parameter, and the stored control calibration data.

16. The apparatus of claim 15, wherein means for sensing the head parameter includes means for sensing a pressure representative of the pressure of the liquid refrigerant in the condenser;

means for sensing a pressure representative of the pressure of the liquid refrigerant in the evaporator;

means for calculating a differential pressure equal to the difference between the condenser pressure and the evaporator pressure; and means for calculating a pressure ratio equal to the ratio between the calculated differential pressure and the evaporator pressure.

17. The apparatus of claim 15, wherein means for sensing the load parameter includes means for sensing a position representative of the position of the pre-rotational vanes.

18. The apparatus of claim 15, wherein means for sensing the head parameter includes means for sensing a pressure representative of the pressure of the liquid refrigerant in the condenser;

means for sensing a pressure representative of the pressure of the liquid refrigerant in the evaporator;

means for calculating a differential pressure equal to the difference between the condenser pressure and the evaporator pressure; and means for calculating a pressure ratio equal to the ratio between the calculated differential pressure and the evaporator pressure; and wherein means for sensing the load parameter includes means for sensing a position representative of the position of the pre-rotational vanes.

19. The apparatus of 18, wherein means for storing the head parameter includes means for storing the pressure ratio, minus a small margin, as a stored control pressure ratio when the surge condition is sensed; and means for storing the corresponding vane position as a stored control vane position when the surge condition is sensed.

20. The apparatus of claim 15, wherein means for sensing the present head parameter includes means for sensing a present pressure representative of the present pressure of the liquid refrigerant in the condenser;

means for sensing a present pressure representative of the present pressure of the liquid refrigerant in the evaporator;

means for calculating a present differential pressure equal to the difference between the present condenser pressure and the present evaporator pressure; and means for calculating a present pressure ratio equal to the ratio between the present calculated differential pressure and the present evaporator pressure.

21. The apparatus of claim 15, wherein means for sensing the present load parameter includes means for sensing a present position representative of the present position of the pre-rotational vanes.

22. The apparatus of claim 15, wherein means for sensing the present head parameter includes means for sensing a present pressure representative of the present pressure of the liquid refrigerant in the condenser;

means for sensing a present pressure representative of the present pressure of the liquid refrigerant in the evaporator;

means for calculating a present differential pressure equal to the difference between the present condenser pressure and the present evaporator pressure;

means for calculating a present pressure ratio equal to the ratio between the present calculated differential pressure and the present evaporator pressure; and means for sensing a present position representative of the present position of the pre-rotational vanes.

23. The apparatus of claim 22, wherein the stored control calibration data includes a stored control pressure ratio and a stored control vane position, said apparatus including means for opening the hot gas bypass valve, if the present pressure ratio is greater than the stored control pressure ratio corresponding to the stored control vane position equal to the present vane position, by an amount proportional to a difference between the present pressure ratio and the stored control pressure ratio.

24. The apparatus of claim 22 wherein the stored calibration data includes a stored control pressure ratio and a stored control vane position, said apparatus including means for closing completely the hot gas bypass valve, if the present pressure ratio is less than or equal to the stored control pressure ratio corresponding to the stored control vane position equal to the present vane position.

25. An apparatus for controlling a hot gas bypass valve in a refrigeration system including a centrifugal compressor, a condenser, pre-rotational vanes, and an evaporator through which a chilled liquid refrigerant is circulated, said apparatus comprising:

means for sensing a present pressure representative of the present pressure of the liquid refrigerant in the condenser;

means for sensing a present pressure representative of the present pressure of the liquid refrigerant in the evaporator;

means for sensing a present vane position representative of the present position of the pre-rotational vanes; and means for controlling the operation of a hot gas bypass valve so as to avoid surging in the compressor in response to the present condenser pressure, the present evaporator pressure, and the present vane position to stored calibration data.

26. The apparatus of claim 25, wherein means for controlling the operation includes means for calculating a present differential pressure equal to the difference between the present condenser pressure and the present evaporator pressure; and means for calculating a present pressure ratio equal to the ratio between the present calculated differential pressure and the present evaporator pressure.

27. The apparatus of claim 25, wherein stored calibration data includes stored control pressure ratios and stored control vane position, said apparatus including means for opening the hot gas bypass valve, if the present pressure ratio is greater than the stored control pressure ratio corresponding to the stored control vane position equal to the present vane position, by an amount proportional to a difference between the present pressure ratio and the stored control pressure ratio.

28. The apparatus of claim 25, wherein stored calibration data includes stored control pressure ratios corresponding to stored control vane positions, said apparatus including means for closing completely the hot gas bypass valve, if the present pressure ratio is less than or equal to the stored control pressure ratio corresponding to the stored control vane position equal to the present vane position.

29. A refrigeration system including a centrifugal compressor, a condenser, pre-rotational vanes, a hot gas bypass valve, and an evaporator through which a chilled liquid refrigerant is circulated, said apparatus comprising:

means for sensing a present pressure representative of the present pressure of the liquid refrigerant in the condenser;

means for sensing a present pressure representative of the present pressure of the liquid refrigerant in the evaporator;

means for sensing a present position representative of the present position of the pre-rotational vanes; and means for controlling the operation of the hot gas bypass valve so as to avoid surging in the compressor in response to a comparison of the present condenser pressure, the present evaporator pressure, and the present vane position, or functions thereof, to stored calibration data.

30. The apparatus of claim 29, wherein means for controlling the operation includes means for calculating a present differential pressure equal to the difference between the present condenser pressure and the present evaporator pressure; and means for calculating a present pressure ratio equal to the ratio between the present calculated differential pressure and the present evaporator pressure.

31. The apparatus of claim 29, wherein stored calibration data includes stored control pressure ratios and stored control vane position, said apparatus including means for opening the hot gas bypass valve, if the present pressure ratio is greater than the stored control pressure ratio corresponding to the stored control vane position equal to the present vane position, by an amount proportional to a difference between the present pressure ratio and the stored control pressure ratio.

32. The apparatus of claim 29, wherein stored calibration data includes stored control pressure ratios corresponding stored control vane positions, said apparatus including means for closing completely the hot gas bypass valve, if the present pressure ratio is less than or equal to the stored control pressure ratio corresponding to the stored control vane position equal to the present vane position.

* * * * *

UNITED STATES PATENT AND TRADEMARK OFFICE

CERTIFICATE OF CORRECTION

PATENT NO. : 6,202,431 B1
DATED : March 20, 2001
INVENTOR(S) : Gregory K. Beaverson et al.

It is certified that error appears in the above-identified patent and that said Letters Patent is hereby corrected as shown below:

Column 10,
Line 32, “method of 4” should read -- method of claim 4 --.

Column 11,
Line 54, after “ratios”, insert -- and --.

Column 12,
Line 48, “apparatus of 18” should read -- apparatus of claim 18 --.

Column 14,
Line 57, after “ratios”, insert -- and --.

Signed and Sealed this

Twenty-seventh Day of May, 2003

JAMES E. ROGAN
*Director of the United States Patent and Trademark Office*